US006078025A

United States Patent [19]

Yeung

[11] Patent Number: 6,078,025

[45] Date of Patent: Jun. 20, 2000

[54] ARTICLE OF CLOTHING

[76] Inventor: Chiu Man Yeung, 6E 35th Floor, Greenfield Garden, Tsing Yi, New Territories, The Hong Kong Special Administrative Region of the People's Republic of China

[21] Appl. No.: 09/324,592

[22] Filed: Jun. 3, 1999

[51] Int. Cl.[7] ..... H05B 1/00

[52] U.S. Cl. ..... 219/211; 219/217; 219/527

[58] Field of Search ..... 219/211, 217, 219/527

[56] References Cited

U.S. PATENT DOCUMENTS

| | | | |
|---|---|---|---|
| 2,458,119 | 1/1949 | Van Daam | 219/211 |
| 3,400,254 | 9/1968 | Takemori | 219/549 |
| 3,524,965 | 8/1970 | Arron | 219/211 |
| 3,751,620 | 8/1973 | Yuasa | 219/211 |
| 3,778,590 | 12/1973 | Lizuka et al. | 219/211 |
| 4,273,989 | 6/1981 | Hinton et al. | 219/211 |
| 4,404,460 | 9/1983 | Kerr | 219/211 |
| 5,008,517 | 4/1991 | Brekkestran et al. | 219/211 |
| 5,023,430 | 6/1991 | Brekkestran et al. | 219/486 |
| 5,032,705 | 7/1991 | Batcheller et al. | 219/211 |
| 5,111,025 | 5/1992 | Barma et al. | 219/217 |
| 5,148,002 | 9/1992 | Kuo et al. | 219/211 |
| 5,302,806 | 4/1994 | Simmons et al. | 219/211 |
| 5,302,807 | 4/1994 | Zhao | 219/211 |
| 5,777,296 | 7/1998 | Bell | 219/211 |
| 5,824,996 | 10/1998 | Kochman et al. | 219/529 |
| 5,866,881 | 2/1999 | Jones, III | 219/527 |
| 5,893,991 | 4/1999 | Newell | 219/211 |

FOREIGN PATENT DOCUMENTS 0287294 10/1988 European Pat. Off. .

*Primary Examiner*—Teresa Walberg
*Assistant Examiner*—Vinod D. Patel
*Attorney, Agent, or Firm*—Leydig, Voit & Mayer

[57] ABSTRACT

An article of clothing includes a body having a rear panel and electrical warming pads sewed to the panel for warming the wearer of the article of clothing. Each warming pad is a flexible sheet heating element. An electronic control circuit is used to control the temperature of the heating elements.

11 Claims, 2 Drawing Sheets

ARTICLE OF CLOTHING

The present invention relates to an article of clothing which is capable of generating heat to supply warmth.

BACKGROUND OF THE INVENTION

It is known to have an article of clothing, or the like such as a blanket, which is capable of generating heat for warming up a wearer by using electrical heating wires or through the mixing of chemicals. However, in practice, it is difficult or at least complicated to make use of electrical heating wires to provide a relative large heating area and/or uniform heating. On the other hand, the mixing of chemicals is only for one-time use.

The invention seeks to mitigate or to at least alleviate such problems by providing an improved article of clothing.

SUMMARY OF THE INVENTION

According to the invention, there is provided an article of clothing comprising a body having a rear panel, a plurality of electrical warming pads sewed to the panel for warming the body of a wearer of the article of clothing, each of which is provided by a flexible sheet of heating element, and an electronic control circuit for controlling the temperature of the heating elements.

Preferably, each heating element is made of a high-polymer material mixed with fine carbon powders.

It is preferred that each heating element is provided with a pair of flexible terminals for electrical connection to the control circuit.

More preferably, each terminal is in the form of a knitted wire mesh.

In a preferred embodiment, each heating element has at least two parts provided with respective pairs of terminals for electrical connection to the control circuit via a switch in a manner which is changeable by means of the switch.

More preferably, said at least two parts of each heating element are electrically connected together in series and share a common terminal between them.

Further more preferably, said at least two parts of each heating element are integral parts with each other.

It is preferred that the connection of said at least two parts of each heating element to the control circuit is changeable between a first manner in which the two parts are electrically connected together in series and a second manner in which the two parts are electrically connected together in parallel.

In a preferred embodiment, the control circuit includes an oscillator for generating a pulse current to drive the heating elements, said pulse current having a pulse width which is adjustable for determining the temperature of the heating elements.

More preferably, the control circuit includes a temperature sensitive element which is provided adjacent to one of the heating elements for temperature sensing and is co-operable with the oscillator for adjusting the pulse width of the pulse current.

It is preferred that the control circuit includes a variable resistor for adjusting the pulse width of the pulse current.

In a specific construction, wherein each heating element is packed between two layers of lining material sewed together to form a respective warming pad.

More specifically, the warming pads are sewed to the rear body panel at positions extending across the shoulder blade position and round the two shoulder positions.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
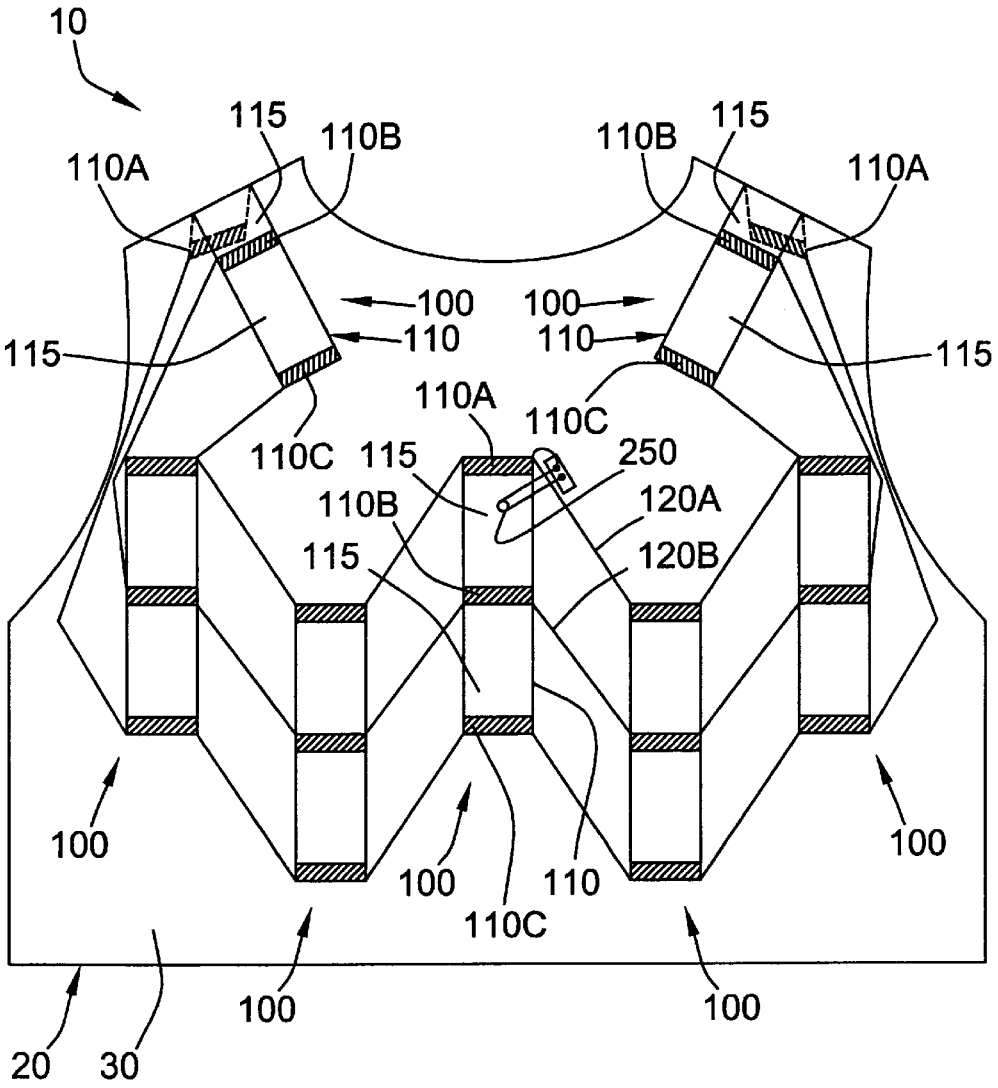
FIG. 1 is a rear view of an embodiment of an article of clothing in accordance with the invention, which is in the form of a vest provided with an arrangement of warming pads.
Figure 2:
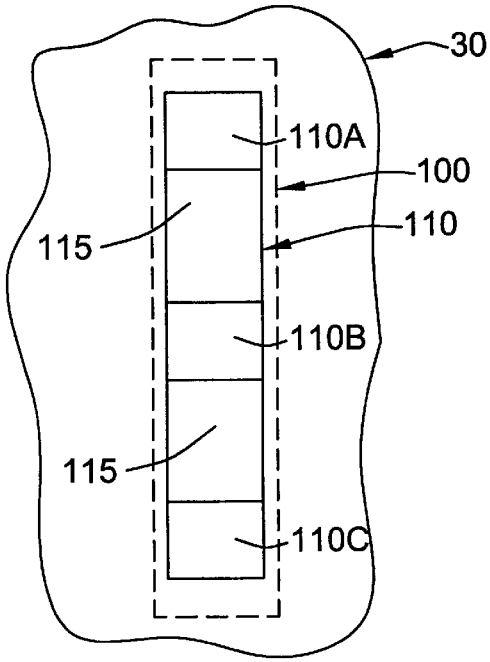
FIG. 2 is a front/rear view of a warming pad of FIG. 1.
Figure 3:
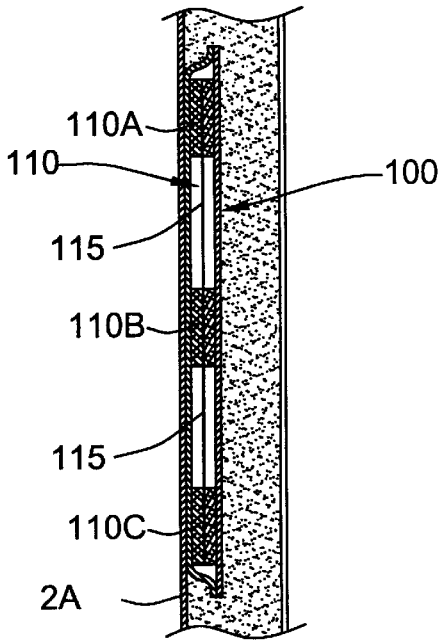
FIG. 3 is a cross-sectional side view of the warming pad of FIG. 2.

Referring initially to FIGS. 1 to 3 of the drawings, there is shown an article of clothing embodying the invention, which is in the form of a vest 10 having a fabric body 20 formed by a front panel (not shown) and a rear panel 30 and including seven electrical warming pads 100 within the rear panel 30. The warming pads 100 are provided at different positions mainly over the rear body panel 30, with five of them as a first group extending at regular intervals across the shoulder blade position and the other two as a second group extending around the respective shoulder positions into the front body panel.

Each warming pad 100 is implemented by a flexible heating membrane or tape 110, which is made of a high-polymer material, such as polytetrafluoroethylene or TEFLON (trade mark), mixed with fine carbon and copper powders in a homogeneous manner. The high-polymer material acts as a binder, and the powder additives serve to render the resulting tape 110 electrically conductive and yet resistive for heat generation upon the flow of an electric current.

The heating tape 110 is fitted with respective electrical terminals 110A to 110C at the first end, middle part and second end, thereby dividing the tape 110 into a series of two integral half sections 115, each having a resistance of 140 ohm. Each terminal 110A/B/C is provided by a flexible sheet of knitted copper wire mesh, to which an electrical wire 120A/B/C is soldered for external connection. The heating tape 110, together with its terminals 110A to 110C, is packed and sewed between two layers 40 of cotton lining to form a respective warming pad 100, for use within the rear body panel 30.

The terminals 110A to 110C of each heating tape 110 are electrically connected with the corresponding terminals 110A to 110C of all the other heating tapes 110 by means of the respective wires 120A, 120B and 120C. The five heating tapes 110 of the first group extend individually vertically and are arranged as a whole horizontally across the shoulder blade position in a zigzag manner or, more specifically, a Wshape to maximise their coverage. The two heating tapes 110 of the second group extend round the respective shoulder positions, with their second ends (terminals 110C) interlacing at a distance from the five first ends (terminals 110A) of the first group, for warming in a manner as uniform as possible.

The front and rear panels 30 of the vest body 20 are formed with an outer layer 22 and a lining 24, between which cotton filling is provided for warmth keeping. The warming pads 100 are sewed directly on the inner surface of the lining 24 of the rear panel 30.

Figure 4:
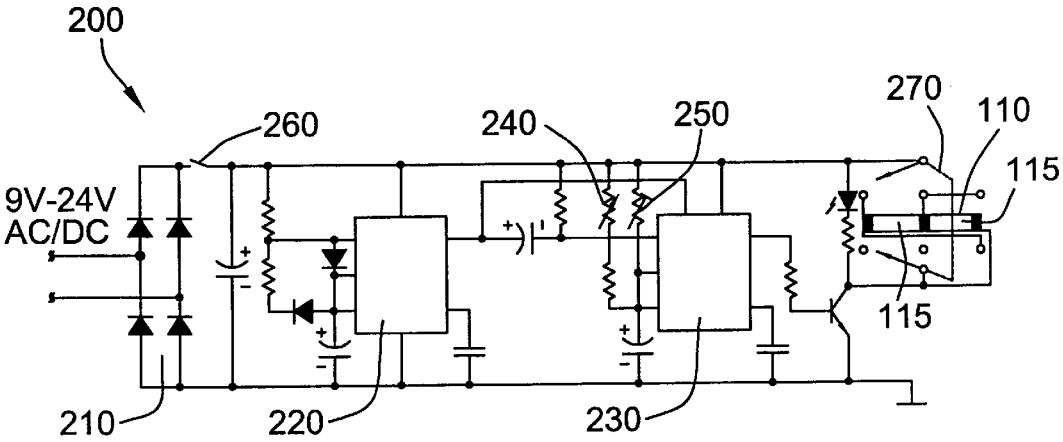
FIG. 4 is a circuit diagram of an electronic control circuit for the warming pads of FIG. 1.

Referring also to FIG. 4 of the drawings, the heating tapes 110 are to be driven by a 9V–24V AC/DC power source under the control of a wired controller having an electronic circuit 200. The controller may include a socket for the connection of an AC power source and/or a battery compartment for the use of battery cells. The control circuit 200 comprises a diode bridge 210 for AC/DC rectification, or alternatively for straight DC connection, and an oscillator implemented by a pair of first and second IC chips 220 and 230 for generating a pulse current having a square waveform to drive the heating tapes 110.

The pulse width or duty cycle of the driving current is adjustable, for controlling the temperature of the heating tapes 110, by using a variable resistor 240 and a negative temperature coefficient (NTC) thermistor 250 connected to the second IC chip 230. The variable resistor 240 is useful for manually presetting the desired operating temperature of the heating tapes 110. The thermistor 250 is attached to the central (or any one) heating tape 110 for sensing its temperature to indicate the general temperature of the heating tapes 110, for automatic temperature control. More specifically, the duty cycle of the driving current can be adjusted to as high as 99% for initial warming, which will eventually be reduced to about 10%–20% for maintaining the preset temperature to avoid over or under heating.

The control circuit 200 includes a master switch 260 for switching on and off the power source and a selector switch 270 for re-arranging the electrical connection of the heating tapes 110 to determine the rate at which their temperature rises.

The selector switch 270 is a 2-throw 3-pole switch and is connected by means of the wires 120A to 120C to the heating tapes 110, in a manner as shown in FIG. 4. In the left position (as shown), the switch 270 connects the heating tapes 110 whole-length together in parallel, which in turn provide a resultant resistance of 40 ohm (280 ohm/7) for a slow temperature rise. When the switch 270 is moved to the middle position, only the right half sections 115 of the heating tapes 110 are connected together in parallel, which provides a resultant resistance of 20 ohm(140 ohm/7) for a medium temperature rise. While in the right position, the switch 270 connects the two half sections 115 of each heating tape 110 in parallel together and with the half sections 115 of the other heating tapes 110 to provide a resultant resistance of 10 ohm (140 ohm/14) for quick temperature rise.

As the heating tapes 110 are flexible and thin and may be cut to any shapes and sewed because of their homogeneous nature, the warming pads 100 are suitable for use in any types of body wear and at any positions as desired. By reason of the homogeneous nature, the heating tapes 110 will provide a uniform warming effect over the area they occupy.

The invention has been given by way of example only, and various modifications of and/or alterations to the described embodiment may be made by persons skilled in the art without departing from the scope of the invention as specified in the appended claims.

What is claimed is:

1. An article of clothing comprising a body having a rear panel, a plurality of electrical warming pads sewed to the rear panel for warming a wearer of the article of clothing, each warming pad including a flexible sheet heating element having first and parts joined at a central terminal, and first and second terminals at opposite ends of the heating element, an electronic control circuit for controlling the temperature of the heating elements, and a multiple pole switch for selectively and alternatively connecting the first and second parts of the heating elements in series and in parallel.

2. The article of clothing as claimed in claim 1, wherein each heating element is a high-polymer material mixed with carbon powder.

3. The article of clothing as claimed in claim 1, wherein the first, second, and central terminals are flexible.

4. The article of clothing as claimed in claim 3, wherein each terminal is a knitted wire mesh.

5. The article of clothing as claimed in claim 1, wherein the first and second parts of each heating element are integral with each other.

6. The article of clothing as claimed in claim 1, wherein the switch selectively and alternatively (i) connects the heating elements in parallel at the respective first and second terminals to the control circuit, (ii) connects the first parts of each of the heating elements in parallel at their respective first and central terminals to the control circuit, and (iii) connects both the first parts of each of the heating elements at their respective first and central terminals in parallel to the control circuit and the second parts of each of the heating elements in parallel at their respective second and central terminals to the control circuit.

7. The article of clothing as claimed in claim 1, wherein the control circuit includes an oscillator for generating a pulsed current to drive the heating elements, the pulsed current having an adjustable pulse width for controlling the temperature of the heating elements.

8. The article of clothing as claimed in claim 7, wherein the control circuit includes a temperature sensitive element located adjacent to one of the heating elements for temperature sensing and operable with the oscillator for adjusting the pulse width of the pulsed current.

9. The article of clothing as claimed in claim 7, wherein the control circuit includes a variable resistor for adjusting the pulse width of the pulsed current.

10. The article of clothing as claimed in claim 1, wherein each heating element is packed between two layers of lining material sewed together to form a respective warming pad.

11. The article of clothing as claimed in claim 10, wherein the warming pads are sewed to the rear both panel at positions extending across a shoulder blade position and around two shoulder positions.

* * * * *